United States Patent [19]

Bromley et al.

[11] 4,254,181

[45] Mar. 3, 1981

[54] FILAMENTS HAVING ALTERNATE S-TWISTED AND Z-TWISTED HELICAL SECTIONS PRODUCED BY CRIMPING FILAMENTS PROVIDED WITH AN ECCENTRIC ANISOTROPY OF SHRINKABLE PROPERTY BY A PREFERENTIAL COOLING ON ONE SIDE UPON EXTRUSION THEREOF THROUGH A SPINNERET

[75] Inventors: James E. Bromley; Jing-Peir Yu, both of Pensacola, Fla.

[73] Assignee: Monsanto Company, St. Louis, Mo.

[21] Appl. No.: 888,280

[22] Filed: Mar. 20, 1978

Related U.S. Application Data

[62] Division of Ser. No. 778,913, Mar. 28, 1977, Pat. No. 4,176,150.

[51] Int. Cl.[3] ..... D01D 5/22; D02G 1/00; D02G 3/00

[52] U.S. Cl. ..... 428/371; 428/362

[58] Field of Search ..... 264/177 F; 428/362, 428/371

[56] References Cited

U.S. PATENT DOCUMENTS

| | | | |
|---|---|---|---|
| 3,323,168 | 6/1967 | Drunen et al. | 264/177 F |
| 3,558,420 | 1/1971 | Opfell | 264/177 F |
| 3,623,939 | 11/1971 | Ono et al. | 264/177 F |

FOREIGN PATENT DOCUMENTS

| | | | |
|---|---|---|---|
| 49660 | 8/1966 | Fed. Rep. of Germany | 264/177 F |
| 853062 | 11/1960 | United Kingdom | 264/177 F |
| 891464 | 3/1962 | United Kingdom | 264/177 F |

*Primary Examiner*—James C. Cannon
*Attorney, Agent, or Firm*—Kelly O. Corley

[57] ABSTRACT

A textured melt-spun filament having alternate S-twisted and Z-twisted helical sections connected by twist reversal regions, the filament having a cross-section comprising a spiral wherein the outer portion of the spiral lies at the inside of the helical sections.

7 Claims, 3 Drawing Figures

FILAMENTS HAVING ALTERNATE S-TWISTED AND Z-TWISTED HELICAL SECTIONS PRODUCED BY CRIMPING FILAMENTS PROVIDED WITH AN ECCENTRIC ANISOTROPY OF SHRINKABLE PROPERTY BY A PREFERENTIAL COOLING ON ONE SIDE UPON EXTRUSION THEREOF THROUGH A SPINNERET

This is a division, of application Ser. No. 778,913 filed Mar. 28, 1977, now U.S. Pat. No. 4,176,150.

The invention relates to a textured melt-spun filament, and more particularly to such a filament having a particular type of texture and having certain types of cross-section.

It is known to produce a filament having alternate S- and Z- twisted sections connected by twist reversed regions. Such filaments are produced by various prior art processes. One such known process is to spin a filament, then either simultaneously or sequentially to draw and false-twist heat-set the filament. A second known process is to pass the drawn filament over a hot knife edge or the like to disorient one side of the filament. Each of these known processes requires a separate and expensive processing step aside from the step of spinning. A third known process is to spin a conjugated filament wherein two polymers of dissimilar properties are united nonconcentrically with respect to the filament axis. This third known process requires elaborate and expensive spinning equipment for melting and extruding the two polymers.

According to the present invention, there is provided a novel filament of the above character and a process for producing such a filament which avoid the disadvantages of the noted prior art processes.

According to a first aspect of the invention, there is provided a filament having crimp comprising alternating S-twisted and Z-twisted helically coiled regions connected by twist reversal regions, the filament having a cross-section comprising a spiral wherein the outer portion of the spiral lies at the inside of the coils of the helically coiled regions.

According to another aspect of the invention, the spiral cross-section is closed at its inner end.

According to another aspect of the invention, the spiral cross-section is open at its inner end.

According to another aspect of the invention, the filament has a denier between about 1.5 and 20.

According to another aspect of the invention, the filament is formed from polyester.

According to another aspect of the invention, the spiral extends over more than 360 degrees.

According to another aspect of the invention, there is provided a process for melt spinning a filament, comprising extruding at a given extrusion rate molten melt-spinnable polymer of fiber-forming molecular weight through a spiral cross-section orifice to form a molten stream having a spiral cross-section, quenching the molten stream in a quench zone into a filament by cooling the outer portion of the spiral more quickly than the inner portion of the spiral, and withdrawing the filament from the quench zone.

According to another aspect of the invention, the molten polymer is polyester.

According to another aspect of the invention, the filament is withdrawn from the quench zone at a sufficiently high rate that the filament has an elongation below 65% in the absence of a further step of drawing.

According to another aspect of the invention, the process further comprises drawing the filament to an elongation between 10% and 45%.

Other aspects of the invention will in part be obvious and will in part appear hereinafter in the following detailed description taken in connection with the accompanying drawing, wherein.

Figure 1:
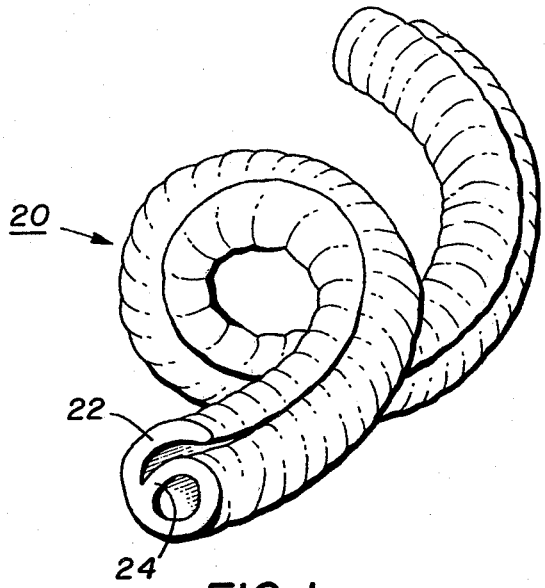
FIG. 1 is a perspective view of a portion of a filament according to the invention.

FIG. 1 shows an S-twisted section of a filament 20 according to the invention wherein the filament cross-section is in the form of a spiral having an outer portion 22 and an inner portion 24. As shown in FIG. 1, the outer portion 24 of the spiral lies at the inside of the coils of the helically coiled region while the remainder of the spiral lies at the outside of the coils of the helically coiled region.

Figure 2:
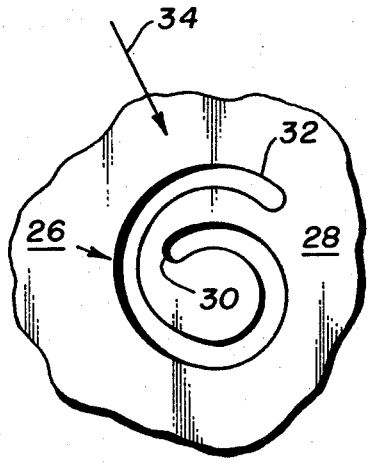
FIG. 2 is a bottom plan view of a first exemplary spinneret according to the invention.

FIG. 2 illustrates a spinneret orifice which may be used for spinning the FIG. 1 filament. Orifice 26 is formed in spinneret plate 28, extending in a spiral from an inner end 30 to the outer end 32. Preferably the spiral extends over more than 360 degrees, as illustrated. If the clearance between inner end 30 and the nearest intermediate portion of slot 26 is sufficiently small, the molten stream issuing therefrom will bridge the gap between the inner end of the spiral cross-sectioned stream and the nearest intermediate portion of the stream cross-section, forming a filament with a spiral cross-section closed at its inner end as illustrated in FIG. 1. On the other hand, if the noted clearance is slightly larger, the bridging will not occur, and the resulting filament will have a spiral cross-section open at its inner end. Selection of the proper clearance to provide either a closed inner end or an open inner end while using particular spinning and quenching conditions can readily be made by one skilled in the art.

Generally speaking, the filament having a cross-section comprising a spiral closed at its inner end will have a more powerful crimp than one having a cross-section comprising a spiral open at its inner end. The latter will, however, have substantially increased moisture transport and moisture holding capacity as compared to the former, which is itself superior to ordinary round filaments.

The following is an example of the preferred embodiment of the invention.

EXAMPLE I

An orifice similar to that in FIG. 2 is used, the slot being 0.1 mm. wide and 4 mm. long along its spiral length. Polyethylene terephthalate polymer of normal textile molecular weight is extruded at a temperature of 290° C. through the orifice and is solidified by transversely directed quenching air into a filament which is wound at 3000 meters per minute. The polymer extrusion rate is selected such that the filament has a denier of 8.5. The quenching air has a temperature of 18° C. and 68% relative humidity, and is directed horizontally at the molten stream in a direction parallel to arrow 34 in FIG. 2, the quenching zone being 1.5 meters long. The quenching air has an average velocity of 20 meters per minute and impinges on the relatively thin fin-like outer portion of the spiral cross-section while the remainder of the molten stream is shielded from the quenching air by the outer portion.

The resulting filament has latent crimp and an elongation of 85%. Upon being hot drawn at a temperature of 100° C. to an elongation of 10–30%, e.g. 20%, the yarn develops more than about 12% crimp with alternating S and Z helical sections, the fin-like portion (the outer portion of the helix which was exposed to quenching air) forming the inside of the helical crimp and the remainder of the filament cross-section forming the outside of the helical crimp.

EXAMPLE II

Example I is repeated except no quenching air is provided. The resulting yarn has no appreciable crimp.

EXAMPLE III

Example I is repeated except that the orifice is round. The resulting yarn has a small amount of crimp, but not to a useful degree.

EXAMPLE IV

The process of Example I is repeated except that the spinneret orifice is rotated 180° in its own plane so that the quenching air has a direction opposite to the arrow in FIG. 1. The resulting filament has slight crimp, but not to a useful degree.

EXAMPLE V

The process of Example I is repeated except the winding speed is increased to 4500 meters per minute. This reduces the filament denier to about 5 and results in a filament with 45% elongation and substantial developed crimp. Upon being tested for crimp as set forth below, the filament develops more than 12% crimp.

The yarn is prepared for crimp testing by being drawn, while heated to a temperature above 70° C., to an elongation of 20% if the elongation exceeds this amount. It is noted that a step of hot drawing can be incorporated in the spinning operation prior to winding the yarn if desired, or can be a subsequent step, and may draw the yarn either partly or entirely down to the elongation range of 10–20%, depending upon the desired end use for the yarn. The prepared yarn is wound into a skein with a 1.25 meter perimeter, the number of loops equalling 6250 divided by the yarn denier and the tension during skeining being 0.035 grams per yarn denier. The skein is then carefully hung on a ½ inch (1.27 centimeter) diameter rod, and a 0.6 gram weight in the form of a metal hook is attached to the bottom of the skein. A 1000 gram weight is suspended from the hook and, after 30 seconds, the skein length from top of rod to top of hook is measured to the nearest millimeter, this measurement being designated hereafter as $L_o$. The 1000 gram weight is then removed, and the skein with hook attached is placed in a 120° C. oven sufficiently large that the skein is suspended from the rod while supporting the hook. After 5 minutes in the oven, the skein is removed and hung, still suspended from the rod, in an atomosphere of 23° C. and 72% relative humidity. After one minute, a 20 gram weight is carefully lowered onto the hook until the skein supports the weight. Care must be taken not to let the weight drop, bounce or otherwise stretch the skein beyond the loading tension. After 30 seconds, the skein length from the top of the rod to the top of the hook is measured to the nearst millimeter, this quantity being identified as $L_f$. The crimp in percent then equals $$(L_o - L_f)\,(100)./L_o.$$

The term "polyester" as used herein refers to polymers of fiber-forming molecular weight composed of at least 85% by weight of an ester of one or more dihydric alcohols and terephthalic acid.

Figure 3:
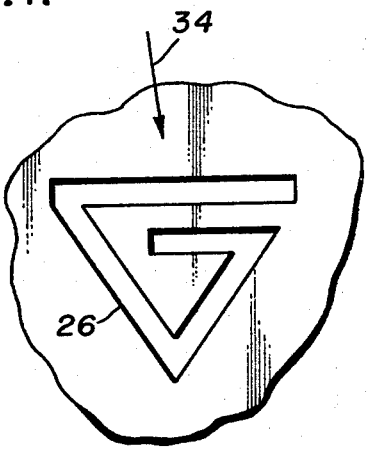
FIG. 3 is a bottom plan view of a second exemplary spinneret according to the invention.

The term "spiral" as used herein comprehends not only cross-sections composed of smooth curves, but cross-sections formed from intersecting straight line segments as well, such as the one illustrated in FIG. 3.

We claim:

1. A filament having crimp comprising alternating S-twisted and Z-twisted helically coiled regions connected by twist reversal regions, said filament having a cross-section comprising a spiral wherein the outer portion of said spiral lies at the inside of the coils of said helically coiled regions and having a crimp of at least 8%.

2. The filament defined in claim 1, wherein said spiral cross-section is closed at its inner end.

3. The filament defined in claim 1, wherein said spiral cross-section is open at its inner end.

4. The filament defined in claim 1, wherein said filament has a denier of between about 1.5 and 20.

5. The filament defined in claim 1, wherein said filament is formed from polyester.

6. The filament defined in claim 1, wherein said spiral extends over more than 360 degrees.

7. The filament defined in claim 1, wherein said filament has a crimp of at least 12%.

* * * * *